US007306329B2

(12) United States Patent
Watarai

(10) Patent No.: US 7,306,329 B2
(45) Date of Patent: Dec. 11, 2007

(54) INKJET RECORDING DEVICE

(75) Inventor: Katsuya Watarai, Ena (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 231 days.

(21) Appl. No.: 11/023,365

(22) Filed: Dec. 29, 2004

(65) Prior Publication Data

US 2005/0162486 A1 Jul. 28, 2005

(30) Foreign Application Priority Data

Jan. 14, 2004 (JP) ..... 2004-006992

(51) Int. Cl.
*B41J 2/175* (2006.01)
*F11L 9/18* (2006.01)

(52) U.S. Cl. ..... 347/85; 138/113

(58) Field of Classification Search ..... 347/85, 347/86, 87; 141/2, 18; 138/113, 114, 118, 138/119

See application file for complete search history.

(56) References Cited

U.S. PATENT DOCUMENTS 5,043,746 A * 8/1991 Abe ..... 347/85
5,469,201 A * 11/1995 Erickson et al. ..... 347/85
5,907,343 A * 5/1999 Takemura et al. ..... 347/108
6,039,428 A * 3/2000 Juve ..... 347/19
6,375,293 B1 * 4/2002 Endo ..... 347/2
6,824,255 B2 * 11/2004 Hino ..... 347/85
7,097,288 B2 * 8/2006 Van Os et al. ..... 347/85

FOREIGN PATENT DOCUMENTS

JP 10217496 * 2/1997
JP A 2003-320679 11/2003

* cited by examiner

*Primary Examiner*—Anh T. N. Vo
(74) *Attorney, Agent, or Firm*—Oliff & Berridge, PLC

(57) ABSTRACT

The present invention provides an inkjet recording device capable of reducing the pressure fluctuation such as the bending or twisting of the ink supplying tube caused by the movement of the carriage. The ink stored in the ink cartridge housing unit is supplied to the inkjet head via the ink supplying tubes. In the course of the ink supplying tubes from the ink cartridge housing unit to the inkjet head, a guide member supports the ink supplying tubes. In the guide member, retaining members for respectively retaining the ink supplying tubes are housed rotatably in the housing units formed with an upper member and a lower member. Further, the guide member is rotatably installed in the case of the inkjet printer by a bolt.

5 Claims, 11 Drawing Sheets

INKJET RECORDING DEVICE

BACKGROUND OF THE INVENTION

1. Field of the Invention

The present invention relates to an inkjet recording device, and in particular relates to an inkjet recording device which supplies ink from an ink supply source via an ink supply tube to a recording head unit capable of recording while reciprocating on the recording medium.

2. Description of the Related Art

An inkjet recording device employing the tube supply system which supplies ink from an ink supply source to a recording head via an ink supply tube is conventionally known. In this inkjet recording device employing the tube supply system, a flexible ink supply tube connects the recording head unit capable of reciprocating along the recording medium and the ink supply source provided to a stationary portion, and the ink stored in the ink supply source is supplied to the recording head unit via the ink supply tube. According to this inkjet recording head employing the tube supply system, since the ink supply source and the recording head unit are provided separately, the recording head unit can be made smaller and lighter, and the recording head can be operated at high speed to enable high speed recording. Further, since the capacity of the ink supply source to be disposed separately from the recording head unit can be increased, the timing of changing the ink tank (supply period of the ink) can be prolonged.

FIG. 16 is a plan sketch view of a conventional inkjet recording device 100; and FIG. 17 is another plan sketch view of a conventional inkjet recording device 100. As shown in FIG. 16 and FIG. 17, the conventional inkjet recording device 100 has an ink supply tube 102 for supplying each of plural inks from the plural ink cartridges 101 to a recording head 104 provided to a carriage 103. The carriage 103 reciprocates along a carriage guide 105, and the ink supply tube 102 follows such carriage 103. In other words, when the carriage 103 moves from the position shown in FIG. 16 toward the right end of the carriage guide 105 as shown in FIG. 17, in a plan view, the ink supply tube 102 also moves pursuant thereto. Each ink supply tube 102 is a flexible tube formed from the likes of polyethylene, and is constituted to bend effectively in accordance with the motion of the cartridge 103 in the main body of the inkjet recording device 100.

In addition, also known is a type in which a rotatable portion for following the carriage is provided to the ink supply tube for supplying ink from the ink cartridge to the recording head provided to the carriage, and constituting such rotatable portion from a combination of a flexible tube having a high degree of hardness and a flexible tube having a small degree of hardness (for example, c.f. Japanese Patent Application Laid-Open No. 2003-320679). As a result, the ink supply tube can be easily bent, and the miniaturization of the recording device and the retention of the gas barrier effect can be realized.

Nevertheless, with this kind of tube system of a conventional ink supply tube, since the ink supply tube also moves roughly parallel in relation to the movement of the carriage, the pressure fluctuation caused by the bending of the ink supply tube due to such movement is considerable, and there is a problem in that the smooth supply of ink would be hindered. Further, since significant stress is applied as a load to the ink supply tube due to the twisting thereof, there is a problem in that this would have an adverse effect on the durability and longevity of the ink supply tube. Moreover, when supplying each of plural inks to the recording head via plural ink supply tubes, the adjacent tubes would become jammed or entangled and apply a great load to the respective ink supply tubes, and there is a problem in that this would have an adverse effect on the smooth supply of ink and the longevity of the ink supply tube.

Further, with the invention described in Japanese Patent Application Laid-Open No. 2003-320679, in addition to special processing being required in the ink supply tube, it does not overcome the problem of the adjacent tubes becoming jammed or entangled when plural tubes are to be used.

SUMMARY OF THE INVENTION

The present invention was devised in order to overcome the foregoing problems, and an object thereof is to provide an inkjet recording device capable of realizing the smooth supply of ink by reducing the pressure fluctuation such as the bending of the ink supply tube caused by the movement of the carriage, and reducing the adverse effect on the durability of the ink supply tube caused by the twisting thereof. Another object of the present invention is to provide an inkjet recording head capable of easily realizing the smooth supply of ink without the adjacent tubes becoming jammed or entangled when plural tubes is to be used.

In order to achieve the foregoing objects, the present invention provides an inkjet recording device which supplies each of plural inks from an ink supply source via plural tubes having flexibility to a recording head unit capable of recording while reciprocating along a recording medium, wherein the plural tubes is provided in a part of the course from the ink supply source to the recording head unit, and has a guide member for supporting the plural tubes and which is rotatable along the reciprocating direction of the recording head unit.

With the inkjet recording device of the present invention, it is preferable that the guide member has a housing unit for housing the tube rotatably around the axis line of the tube. Furhter, it is preferably that the housing unit is an approximately cylindrical through hole through which the tube passes, and an approximately cylindrical retention member for retaining the tube is supported rotatably around the axis line of the housing unit inside the housing unit. Moreover, it is preferably that the plural housing units are provided in correspondence with each of the plural tubes, each of the plural units are provided in parallel, and each of the plural housing units are provided such that the respective axis lines thereof are formed on the same plane.

The present invention also provides an inkjet recording device which supplies each of plural inks from an ink supply source via plural tubes having flexibility to a recording head unit capable of recording while reciprocating along a recording medium, wherein the plural tubes are provided in a part of the course from the ink supply source to the recording head unit, and has a guide member for supporting the plural tubes; and the guide member has a housing unit for housing the tube rotatably around the axis line of the tube.

With the inkjet recording device of the invention, since a guide member which follows and rotates pursuant to the movement of the carriage is provided, a smooth supply of ink is realized by reducing the pressure fluctuation caused by the bending of the ink supply tube during the movement of the carriage.

When the guide member has a housing unit capable of housing plural ink supply tubes in a rotatable manner, the ink supply tube is able to rotate upon following the movement of the carriage, and the pressure fluctuation caused by the bending of the inkjet supply tube can be reduced thereby. In addition, the adverse effect on the durability of the ink supply tube caused by the twisting thereof can also be reduced.

Moreover, when the housing unit of the guide member rotatably supports a retaining member for retaining the ink supply tube, the retaining member for retaining the ink supply tube is able to rotate upon following the movement of the carriage, a smooth supply of ink is realized by reducing the pressure fluctuation caused by the bending of the ink supply tube during the movement of the carriage, and the adverse effect on the durability of the ink supply tube caused by the twisting thereof can also be reduced.

Further, when plural ink supply tubes is supported in parallel and at the same height, the smooth supply of ink can be easily realized without the adjacent tubes becoming jammed or entangled, and the adverse effect on the durability of the ink supply tube can also be reduced.

In the present invention, when a guide member having a housing unit capable of housing plural ink supply tubes in a rotatable manner is provided, the ink supply tube is able to rotate upon following the movement of the carriage, the pressure fluctuation caused by the bending of the inkjet supply tube can be reduced, and the smooth supply of ink can be easily realized without the adjacent tubes becoming jammed or entangled.

BRIEF DESCRIPTION OF THE DRAWINGS

FIG. 10 is a side sketch view of the inkjet printer 1;

FIG. 13 is another external perspective sketch view of the inkjet printer 1;

FIG. 15 is an external perspective view of the protective member 70;

DESCRIPTION OF THE PREFERRED EMBODIMENTS

Figure 1:
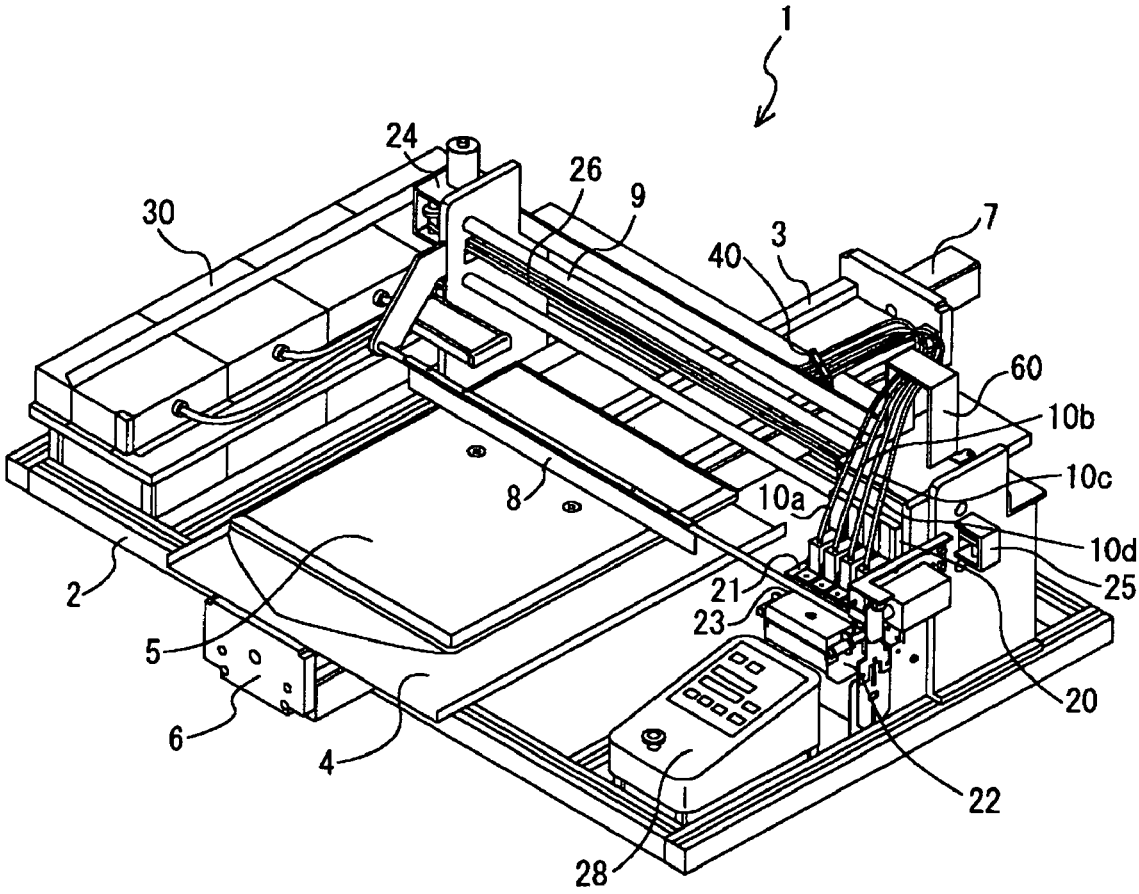
FIG. 1 is an external perspective view of the inkjet printer 1 according to the first embodiment.

The first embodiment of the inkjet recording device realizing the present invention is now explained with reference to the drawings. Foremost, the overall constitution of an inkjet printer 1, which is an example of the inkjet recording device, is explained with reference to FIG. 1. FIG. 1 is an external perspective view of the inkjet printer 1 according to the first embodiment. In the present embodiment, the inkjet printer 1 is a professional-use inkjet printer for printing on fabric such as T-shirts based on the input image information or the like.

As shown in FIG. 1, the inkjet printer 1 has an approximately cuboid case 2 with the horizontal direction (right and left direction) thereof being the longitudinal direction, and two rails 3 are arranged facing the cross direction (front and rear direction) at the approximate center of the bottom face thereof. These two rails 3 are respectively supported on the base portion (not shown) set up in the vertical direction of the case 2, and a tabular platen support (not shown) movable in the cross direction of the case 2 along the rails 3 is supported at the top portion thereof. And, a replaceable platen 5 is fixed to the upper end of the columnar support set up vertically to the approximate center of the platen support.

The platen 5, in a plan view, is an approximately rectangular plate with the cross direction of the case 2 as the longitudinal direction thereof, and is used for horizontally mounting on the top face thereof a recording medium formed from fabric such as a T-shirt. Provided to the top face of the platen 5 is a non-slip member (not shown) for preventing the mounting position of a T-shirt or the like mounted with the printing surface thereof in a state of tension from slipping during the printing. Further, a tray fixed with a columnar support at an approximately middle position between the platen 5 and the platen support has a bottom face approximately parallel with the top face of the platen 5, and, in a plan view, the outer periphery of the tray is constituted to be slightly larger than the platen 5. This tray 4 receives the sleeve or the surplus portion of the T-shirt or the like upon the user mounting such T-shirt on the platen 5, and is used for preventing the T-shirt from falling on the bottom face of the case 2.

Moreover, a platen drive motor 7 is provided to the rear end of a platen drive mechanism 6, which is provided with a rail 3 for moving the platen support, and, as a result of this platen drive motor 7 being driven, the platen support will move in the cross direction of the case 2 along the rail 3. In other words, a drive belt is placed around the drive axis of the platen drive motor 7 and the pulley provided in the vicinity of the front end of the rail 3 (end of the rail 3 which corresponds to the front side of the case 2), and the platen support fixed to the drive belt is able to reciprocate in the cross direction of the case 2 along the rail 3 based on the drive of the platen drive motor 7, which is a stepping motor.

Further, at the approximate center in the cross direction of the case 2 and at the upper position of the platen 5, a guide rail 9 for guiding the movement of a carriage 20 mounting an inkjet head 21 is installed between both side faces of the case 2. A carriage belt 26 installed between a carriage motor 24 provided in the vicinity of the left end of this guide rail 9 and a pulley 25 provided in the vicinity of the right end thereof is disposed across either side of the case 2 at a position lower than the guide rail 9. The carriage belt 26 is fixed to the back face of the carriage 20, and, as a result of the carriage motor 24 being driven, the carriage 20 is able to reciprocate in the horizontal direction of the case 2 along the guide rail 9 engaged with the engagement unit (not shown) similarly provided to the back face. The carriage motor 24 is a DC motor, and the positional detection of the carriage 20 is conducted based on the output from the linear encoder (not shown) provided to the guide rail 9.

A clearance sensor 8 is provided across either side of the case 2 at a position more forward than the guide rail 9. When the platen 5 moves from the front to the rear of the case 2 along the rail 3 upon performing the recording, the clearance sensor 8 detects the wrinkles of the recording medium or obstacles such as dust. Further, an operation panel 28 for operating the inkjet printer 1 is provided at a position on the right front portion of the case 2.

The carriage 20 has an approximate cuboid shape, and four piezoelectric inkjet heads 21 are mounted on the bottom face thereof. These four inkjet heads 21 are, for instance, provided in correspondence with the four color inks of cyan, magenta, yellow and black, and respectively comprise, for example, 128 channels (not shown) for emitting a jet of the respective inks. Each channel is provided with a piezoelectric actuator (not shown) driven individually, and is controlled such that the droplets of ink are emitted in a jet downward from minute jet nozzles formed at the bottom face of the inkjet head 21 in correspondence with the respective channels.

An ink cartridge housing unit 30 for detachably accommodatiug an ink cartridge housing the respective inks is respectively provided to the left side of the inkjet printer 1. Each ink cartridge housing unit 30 and each inkjet head 21 are respectively connected with ink supply tubes 10*a* to 10*d*, and the ink accommdated in each ink cartridge housing unit 30 is supplied to each channel via each of the respectively connected ink supply tubes 10*a* to 10*d*. In FIG. 1, provided is an ink cartridge housing unit 30 of four types of ink based on the CMYK method (cyan, magenta, yellow, black), and the ink supply tubes 10*a* to 10*d* are attached to the ink supply port of the respective ink cartridge housing units 30. The ink supply tubes 10*a* to 10*d* are flexible tubes formed from polyethylene or the like, and possess flexibility for creating bending or twisting in correspondence with the movement of the carriage 20 in the inkjet printer 1.

The four ink supply tubes 10*a* to 10*d* illustrated in FIG. 1 are connected to the inkjet head 21 of each color from each ink cartridge housing unit 30 via the guide member 40 and the tube support member 60. The guide member 40 is provided at approximately the center in the horizontal direction of the case 2 and at an upward position of the platen 5, and is used for supporting the four ink supply tubes 10*a* to 10*d* at the rear of the carriage 20. Further, the tube support member 60 is provided to the upper end of the carriage 20 and is used for supporting the four ink supply tubes 10*a* to 10*d*. And, via this tube support member 60, each of the ink supply tubes 10*a* to 10*d* is attached to the inkjet heads 21 of the respective colors located immediately below the front of the tube support member 60 so as to supply ink inside the inkjet head 21.

Moreover, at the position where the carriage 20 moves to the right end of the guide rail 9, provided is a purge unit 22 having a suction cap 23 capable of firmly attaching to and detaching from the nozzle face of the respective inkjet heads 21. The purge unit 22 is provided with a suction pump (not shown), and, when the respective suction caps 23 are firmly attached to the inkjet head 21, the suction of ink via the suction cap 23 is enabled. Further, when printing is not being conducted, the nozzle face of the inkjet head 21 is covered with the suction cap 23, and the drying of the ink is thereby prevented.

Figure 2:
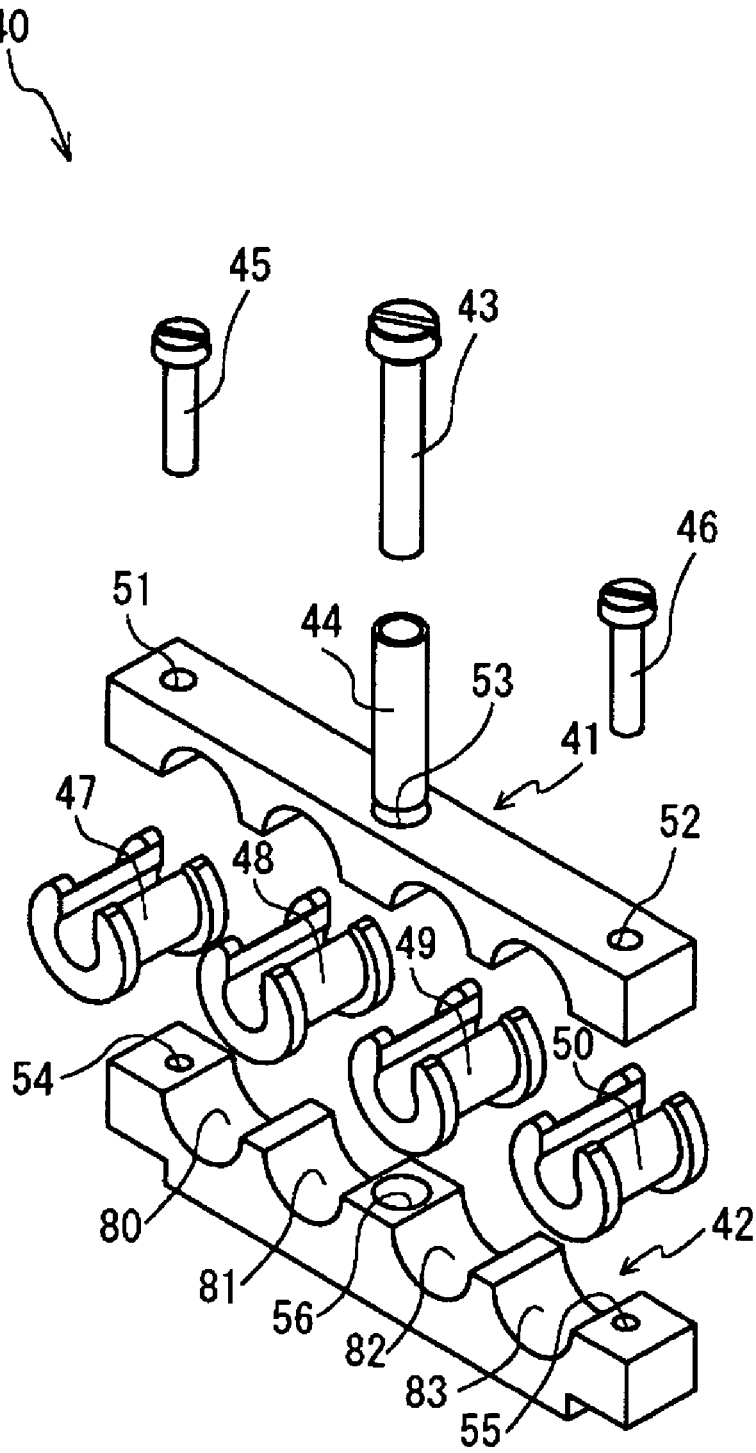
FIG. 2 is a three-dimensional configuration of the guide member 40.
Figure 3:
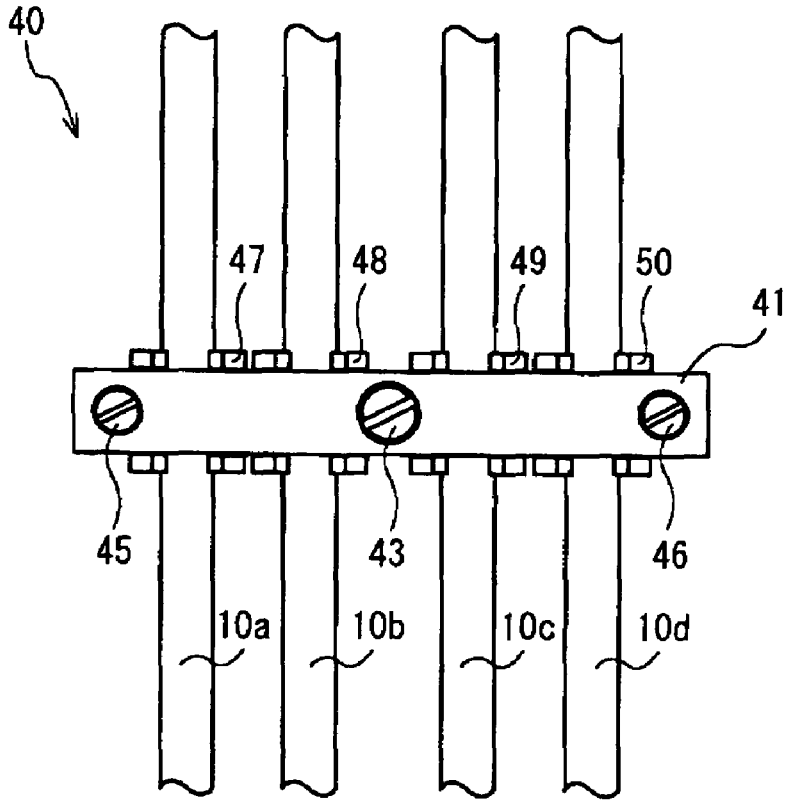
FIG. 3 is a plan view of the guide member 40.
Figure 4:
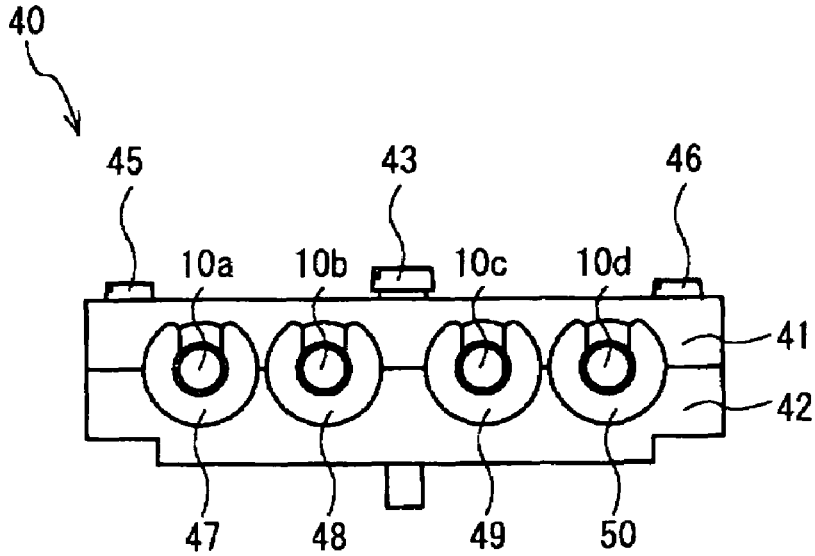
FIG. 4 is a front view of the guide member 40.
Figure 5:
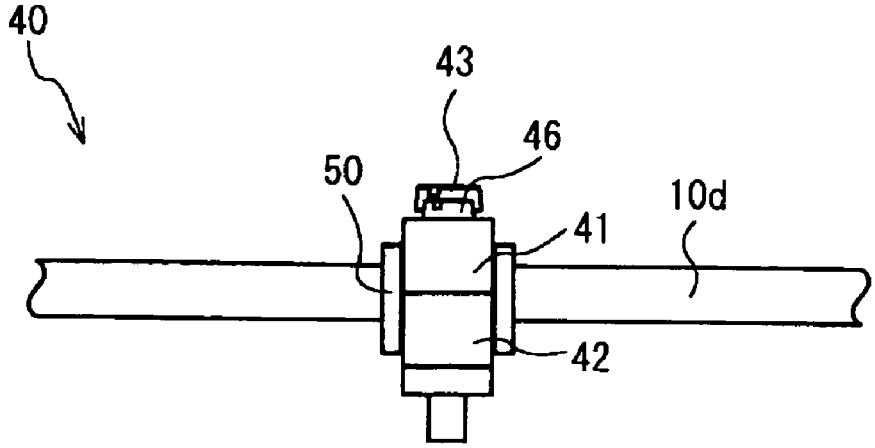
FIG. 5 is a side view of the guide member 40.
Figure 6:
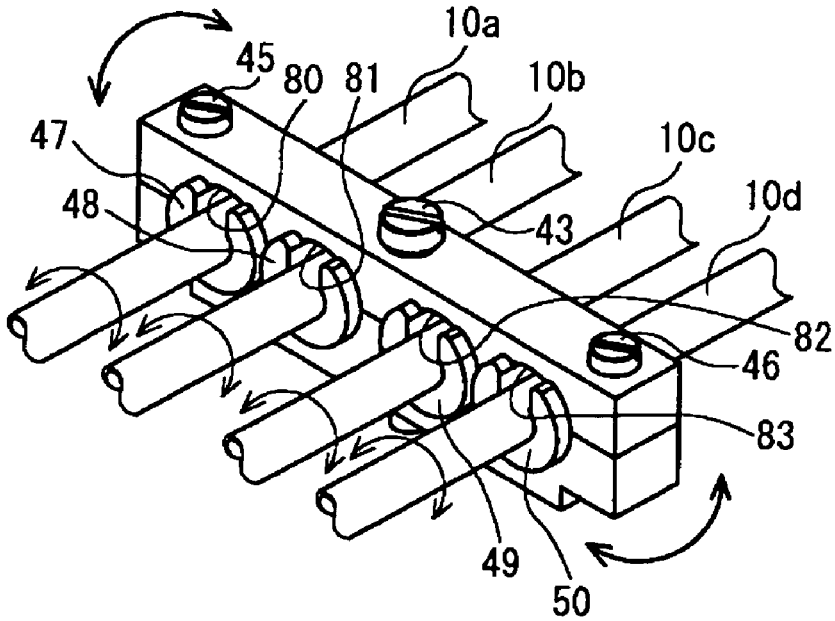
FIG. 6 is an external perspective view of the guide member 40.

Next, the constitution of the guide member 40 is explained with reference to FIG. 2 to FIG. 6. FIG. 2 is a three-dimensional configuration of the guide member 40; FIG. 3 is a plan view of the guide member 40; FIG. 4 is a front view of the guide member 40; FIG. 5 is a side view of the guide member 40; and FIG. 6 is an external perspective view of the guide member 40.

As shown in FIG. 2, the guide member 40 is a plastic member constituted from the primary components of an approximately cuboid upper member 41 and a lower member 42. A bolt hole 51 is provided to the left end of the upper member 41, and a bolt hole 52 is provided to the right end thereof, and a bolt hole 53 is provided to the approximate center thereof. A bolt hole 54 is provided to the left end of the lower member 42, and a bolt hole 55 is provided to the right end thereof, and a bolt hole 56 is provided to the approximate center thereof. A bolt 45 is connected with the bolt hole 51 and bolt hole 54, and a bolt 46 is connected with the bolt hole 52 and bolt hole 55. As a result, the upper member 41 and lower member 42 will be screwed together with the bolts 45, 46, and integrally form a cuboid. Further, a bearing member 44 is inserted through the bolt hole 53 and bolt hole 56, and the bolt 43 is bolted through the inside of the bearing member 44. Moreover, the lower end of the bolt 43 is fixed to the inkjet printer 1. Thereby, the guide member 40 having as its primary component the upper member 41 and lower member 42 formed integrally is installed in the inkjet printer 1. Specifically, the guide member 40 is fixed at the rear of the carriage 20 at the approximate center in the horizontal direction of the case 2 and at the upper position of the platen 5. Incidentally, the bolt 43 is inserted in a state where a slight gap is provided in relation to the bearing member 44. Thus, the upper member 41 and lower member 42 connected to the approximate cuboid are constituted to be rotatable via the bearing member 44 around the axis of the bolt 43 fixed in the vertical direction.

Further, four semicircle columnar grooves are formed at the bottom face of the upper member 41, and four semicircle columnar grooves are also formed at the upper face of the lower member 42. When the upper member 41 and lower member 42 are connected, the housing units 80, 81, 82 and 83, which are four approximately cylindrical through holes, are formed in parallel and at the same height. Approximately cylindrical retaining members 47, 48, 49 and 50 are respectively inserted and housed in the housing units 80, 81, 82 and 83. The retaining members 47, 48, 49 and 50 are used for respectively pinching each of the four ink supply tubes 10*a* to 10*d* and fixing them inside the housing units 80, 81, 82 and 83. Thus, insert grooves to which the respective ink supply tubes 10 are to be inserted are respectively formed to the retaining members 47, 48, 49, 50 in the axis line direction of the housing units 80, 81, 82 and 83.

The diameter of the retaining members 47, 48, 49 and 50 is smaller than the diameter of the housing units 80, 81, 82 and 83 formed with the upper member 41 and lower member 42. Meanwhile, both end faces of the retaining members 47, 48, 49 and 50 are protruding toward the outside of the housing units 80, 81, 82 and 83 formed with the upper member 41 and lower member 42. In addition, such protruding portion has an expanding diameter, and the diameter at both end faces of the retaining members 47, 48, 49 and 50 is larger than the diameter of the housing units 80, 81, 82 and 83. Thus, the retaining members 47, 48, 49 and 50 are housed inside the housing units 80, 81, 82 and 83, and also able to rotate around the axis line of the housing units 80, 81, 82 and 83.

As shown in FIG. 3 to FIG. 6, the guide member 40 collectively supports the ink supply tubes 10*a* to 10*d*, and the four ink supply tubes 10*a* to 10*d* are disposes in parallel in approximately even intervals, and supported at the same height. In other words, the ink supply tube 10*a* is pinched by the retaining member 47, the ink supply ink tube 10*b* is pinched with the retaining member 48, the ink supply ink tube 10*c* is pinched with the retaining member 49, and the ink supply tube 10*d* is pinched with the retaining member 50, and supported by the guide member 40. Thus, although the pinched ink supply tubes 10*a* to 10*d* are fixed immovably in the axis line direction of the housing units 80, 81, 82 and 83, they are rotatable around the axis line of the retaining members 47, 48, 49 and 50, and, therefore, the ink supplies tubes 10*a* to 10*d* are able to rotate around the axis line upon following the movement of the carriage. Moreover, since the guide member 40 is able to rotate around the bolt 43 fixed in the vertical direction based on the internal bearing member 44, the guide member 40 is able to rotate upon following the movement of the carriage. Thus, it is possible to alleviate the pressure such as bending or twisting applied to the ink supply tubes 10*a* to 10*d*, and the pressure fluctuation thereof can be reduced.

Figure 7:
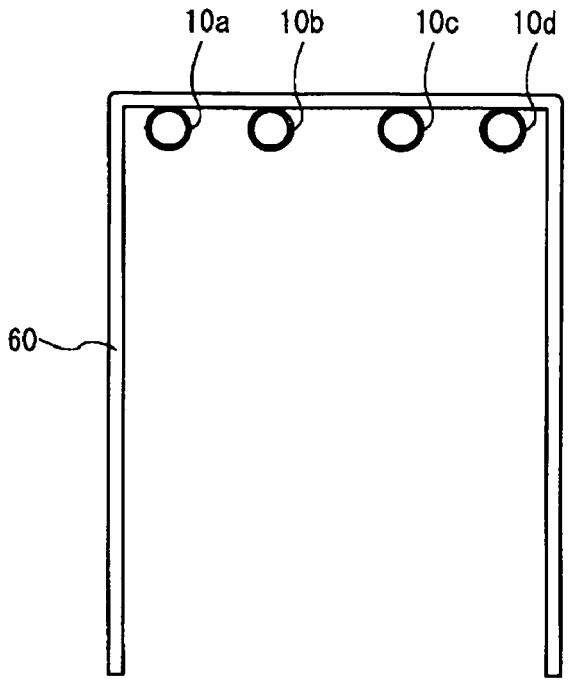
FIG. 7 is a front view of the tube support member 60.
Figure 8:
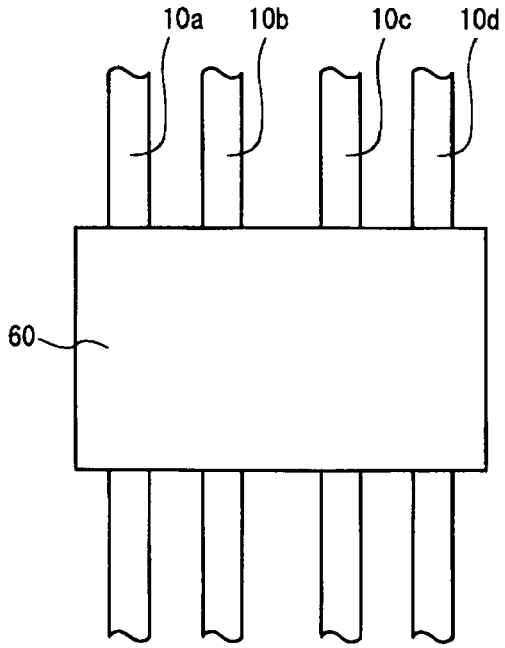
FIG. 8 is a plan view of the tube support member 60.
Figure 9:
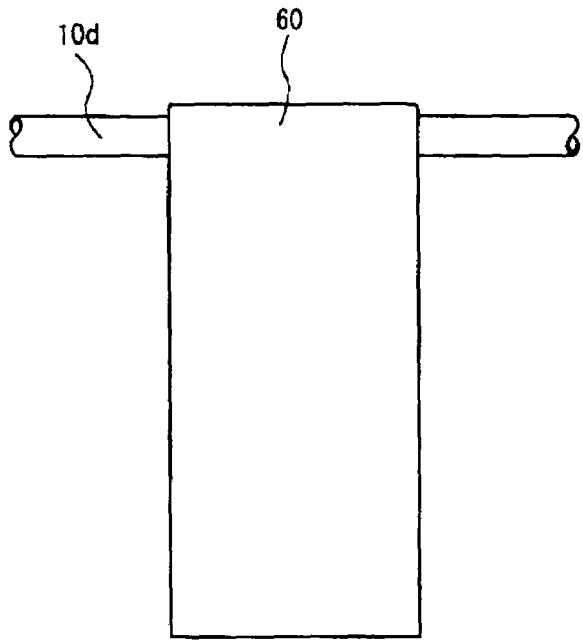
FIG. 9 is a right side view of the tube support member 60.
Figure 1:
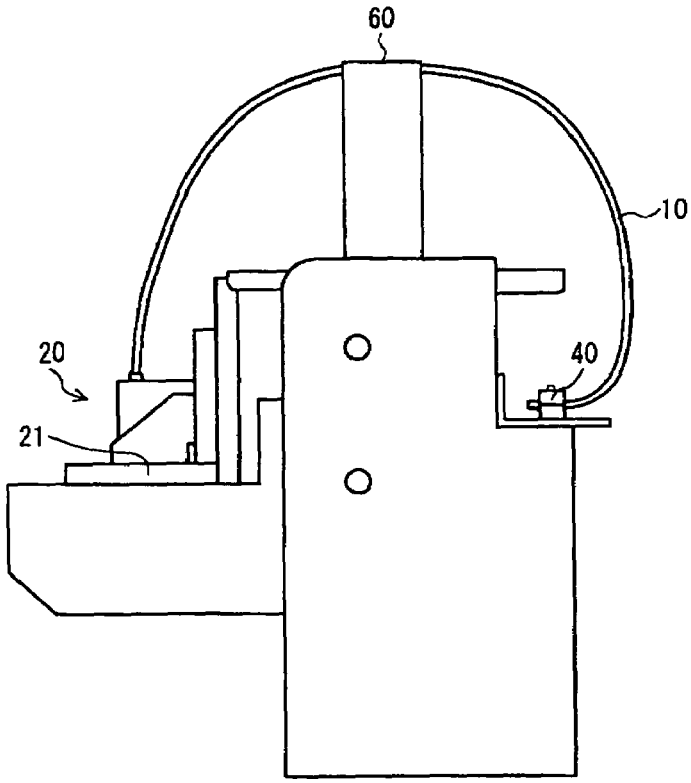

Next, the constitution of the tube support member 60 is explained with reference to FIG. 7 to FIG. 9. FIG. 7 is a front view of the tube support member 60; FIG. 8 is a plan view of the tube support member 60; and FIG. 9 is a right side view of the tube support member 60.

As shown in FIG. 7 and FIG. 8, the tube support member 60 mounted on the top portion of the carriage is a U-shaped metal member, and the front face, rear face and bottom face thereof are opened. The ink supply tubes 10*a* to 10*d* are attached to the reverese portion of the top face of the tube support member 60, in a front view, in parallel and in equal intervals. In the present embodiment, although the ink supply tubes 10*a* to 10*d* are attached to the reverse portion of the top face of the tube support member 60 with an adhesive, these may be attached with a different fixation means. As shown in FIG. 9, the ink supply tubes 10*a* to 10*d* are supported so as to raise the portion to which the ink supply tubes 10*a* to 10*d* are attached in the tube support member 60. In FIG. 9, the right side is the rear face direction of the case 2, and the ink supply tubes 10*a* to 10*d* are respectively extending toward the guide member 40. Further, the left side is the front face direction of the case 2, and the ink supply members 10*a* to 10*d* are respectively extending toward the inkjet head 21 provided immediately below the front part when viewed from the front face of the guide member 40.

Since a tube support member 60 for supporting the ink supply tubes 10*a* to 10*d* for supplying ink to the inkjet head 21 is provided to the top portion of the carriage 20 as described above, the tube support member 60 will move by following the carriage 20. Thus, even when the carriage 20 is moving, the ink supply tubes 10*a* to 10*d* provided between the inkjet head 21 and the tube support member 60 will not be subject to a significant pressure fluctuation such as twisting or bending.

Figure 11:
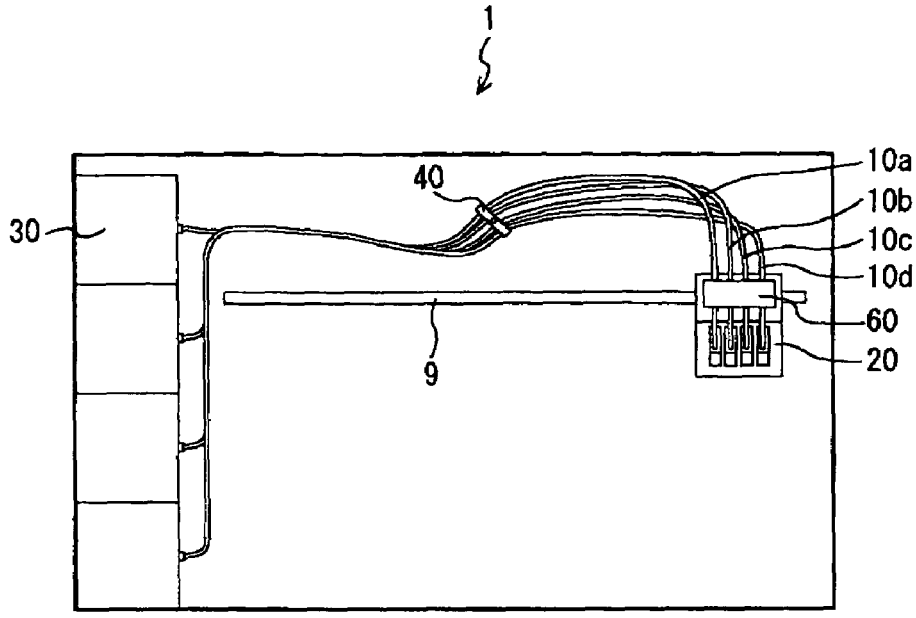
FIG. 11 is a plan sketch view of the inkjet printer 1.
Figure 12:
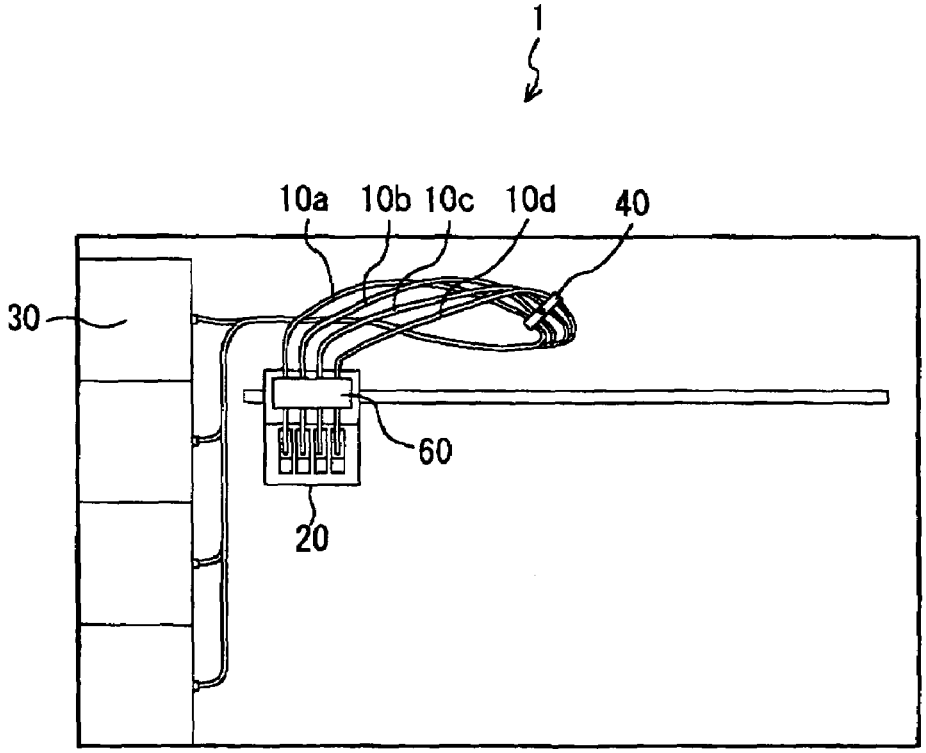
FIG. 12 is another plan sketch view of the inkjet printer 1.
Figure 1:
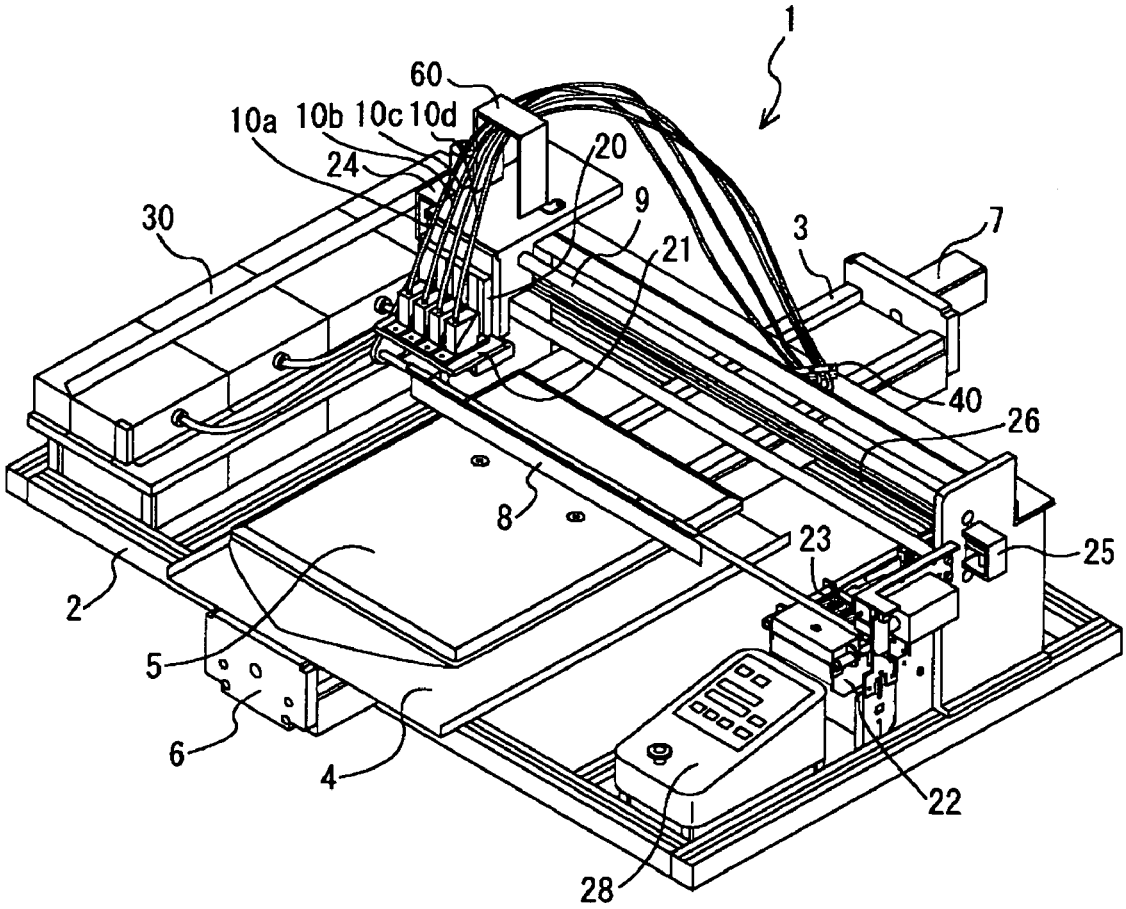

Next, the operation of the carriage 20, which has the inkjet head 21 mounted thereon, during the reciprocating motion thereof in the inkjet printer 1 having the foregoing constitution is explained with reference to FIG. 1 and FIG. 10 to FIG. 13. FIG. 10 is a side sketch view of the inkjet printer 1; FIG. 11 is a plan sketch view of the inkjet printer 1; FIG. 12 is another plan sketch view of the inkjet printer 1; and FIG. 13 is another external perspective sketch view of the inkjet printer 1.

With the inkjet printer 1 shown in FIG. 1, the carriage 20 having the inkjet head 21 mounted thereon is located at a position facing the purge unit 22 on the right end of the guide rail 9, and this state is the default state prior or subsequent to the implementation of printing. FIG. 11 is a plan sketch view corresponding to the default state shown in FIG. 1, and illustrates the position of the carriage 20 in the default state and the state of the ink supply tubes 10*a* to 10*d* to follow the carriage 20.

As shown in FIG. 10, the ink supply tubes 10*a* to 10*d* (illustrated as ink supply tube 10 in FIG. 10) installed to the respective ink cartridge housing units 30 are installed to their respective inkjet heads 21 to supply ink via the guide member 40 and tube support member 60. The guide member 40 is provided at approximately the center in the horizontal direction of the case 2 and at the rear of the carriage 20, and the ink supply tubes 10*a* to 10*d* are constituted so as to pass through the guide member 40 toward the cross direction of the case 2. The ink supply tubes 10*a* to 10*d* guided toward the rear face of the case 2 in the guide member 40 are supported in a state of being raised with the tube support member 60 mounted on the carriage 20 located at the front upward portion of the guide member 40 when viewed from the front face thereof. The ink supply tubes 10*a* to 10*d* guided by the tube support member 60 are installed to the inkjet head 21 located at the front downward portion of the tube support member 60 when viewed from the front face thereof, and respectively supply ink.

As shown in FIG. 1 and FIG. 11, since the carriage 20 is positioned at the right end of the guide rail 9 in a default state, the ink supply tubes 10*a* to 10*d* guided from the guide member 40 are also extending toward the right end direction in pursuit of the carriage 20. When the carriage 20 moves to the right end, since pressure such as twisting and bending is applied to the ink supply tubes 10*a* to 10*d*, they are rotated so as to reduce the pressure fluctuation in the guide member 40. Specifically, the guide member 40 for alleviating the bending pressure to the ink supply tube 10 is inclined obliquely toward the right side. Further, the retaining members 47, 48, 49 and 50 also rotate so as to alleviate the twisting pressure to the ink supply tubes 10*a* to 10*d*, and rotates so as to return the twisting to its original position when the ink supply tube 10 is twisted.

Meanwhile, upon recording with the inkjet printer 1, printing with the inkjet head 21 is performed by the carriage reciprocating along the guide rail 9. As shown in FIG. 12 and FIG. 13, when the carriage 20 moves to the left end of the guide rail 9, since the ink supply tubes 10*a* to 10*d* will be subject to pressure such as twisting or bending, they are rotated so as to reduce the pressure fluctuation in the guide member 40. Specifically, the guide member 40 is inclined obliquely toward the left side, in order to alleviate the bending pressure to the ink supply tube 10. Further, the retaining members 47, 48, 49 and 50 also rotate so as to alleviate the twisting pressure to the ink supply tubes 10*a* to 10*d*, and rotates so as to return the twisting to its original position when the ink supply tube 10 is twisted.

As described above, with the inkjet printer 1 according to the first embodiment, a guide member 40 for supporting plural ink supply tubes 10*a* to 10*d* was provided, and such guide member 40 follows the movement of the carriage 20 and rotates around the vertical direction. And, with the guide member 40, in addition to the ink supply tubes 10*a* to 10*d* being respectively pinched with the housing units 80, 81, 82 and 83, the ink supply tubes 10*a* to 10*d* are retained to be rotatable around the respective axes upon following the movement of the carriage 2. As a result, a smooth supply of ink is realized by reducing the pressure fluctuation caused by the bending of the ink supply tube during the movement of the carriage 20, and the adverse effect on the durability of the ink supply tube caused by the twisting thereof can also be reduced.

Further, since the ink supply tubes 10*a* to 10*d* are supported in parallel and at the same height in the guide member 40, it is possible to prevent the adjacent tubes from becoming jammed or entangled. Further, since a tube support member 60 for retaining the tubes in parallel and in even intervals, similarly to the case of the guide member 40, has been provided to the carriage 20, the jamming or entanglement of the tubes can be surely prevented. As a result, the smooth supply of ink is realized, and the adverse effect on the durability of the ink supply tube can also be reduced.

Moreover, even with a conventional inkjet recording device, if the guide member 40 and tube support member 60 of the present invention can be employed therein, the inkjet printer 1 of the present invention can be realized easily without requiring any significant modification. And, the significant effect of the present invention, which is to realize the smooth supply of ink by reducing the pressure fluctuation caused by the bending of the ink supply tube during the movement of the carriage, and to reduce the adverse effect on the durability of the ink supply tube caused by the twisting thereof, can also be yielded in the conventional inkjet recording device.

Figure 14:
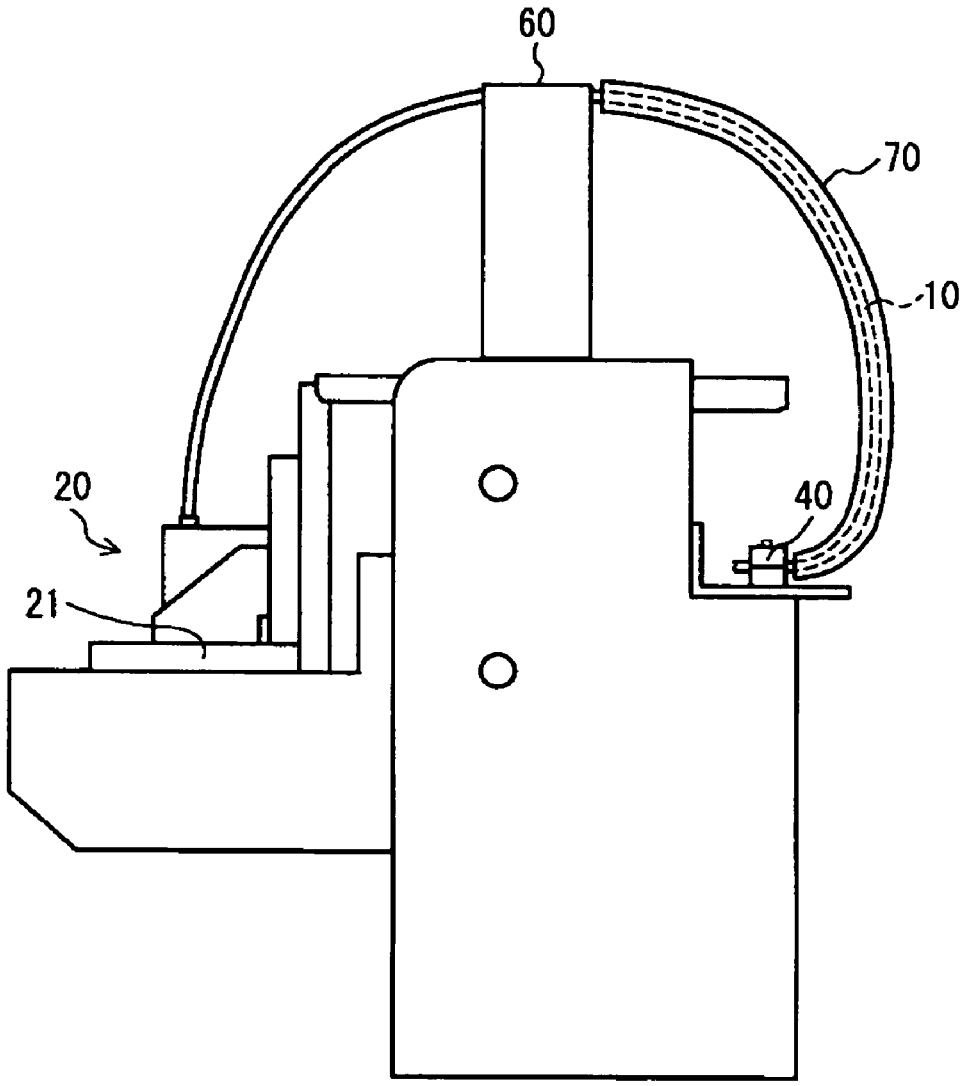
FIG. 14 is a side sketch view of the inkjet printer 1 according to the second embodiment.
Figure 1:
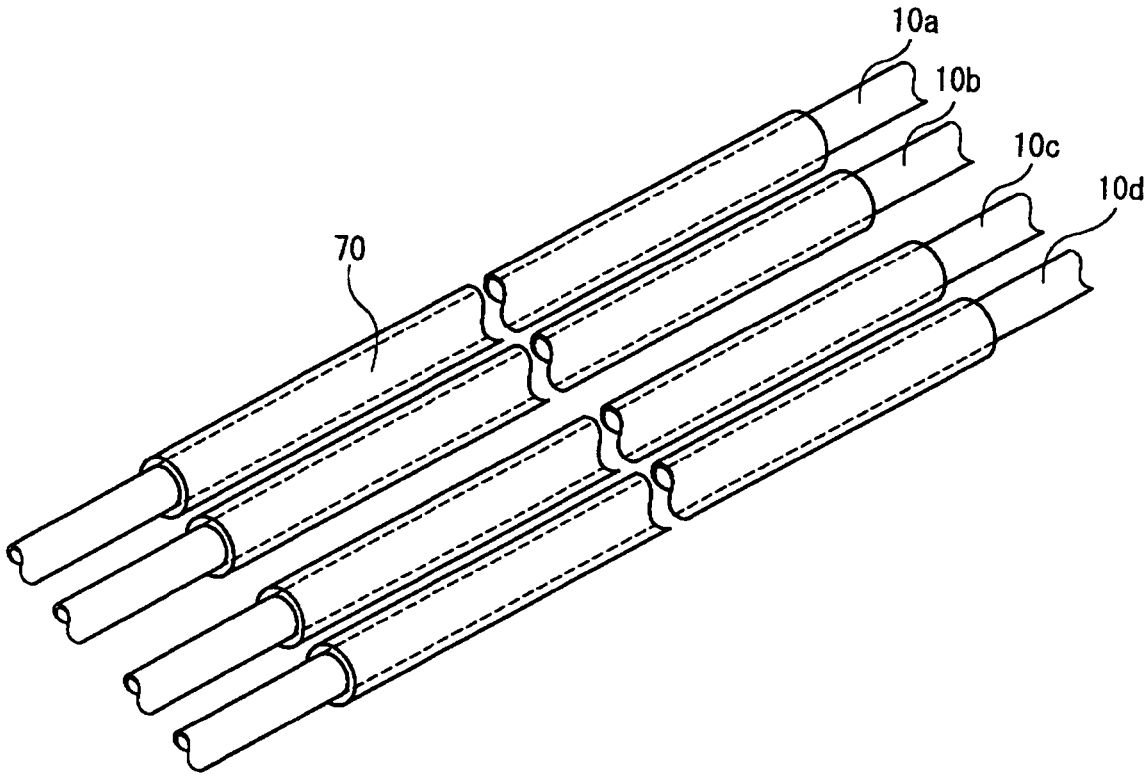
Figure 16:
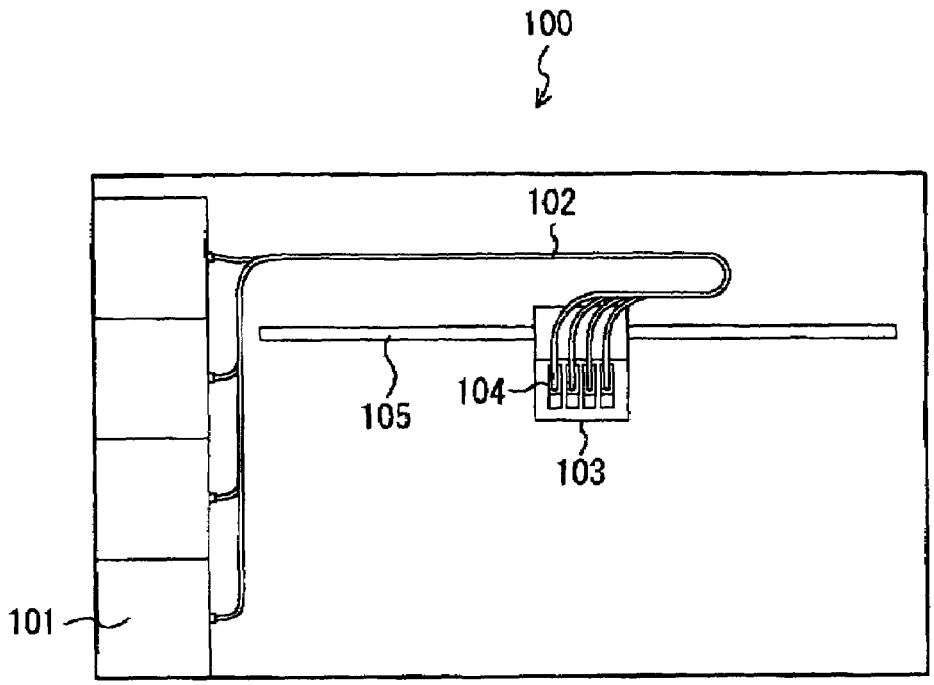
FIG. 16 is a plan sketch view of a conventional inkjet recording device 100.
Figure 17:
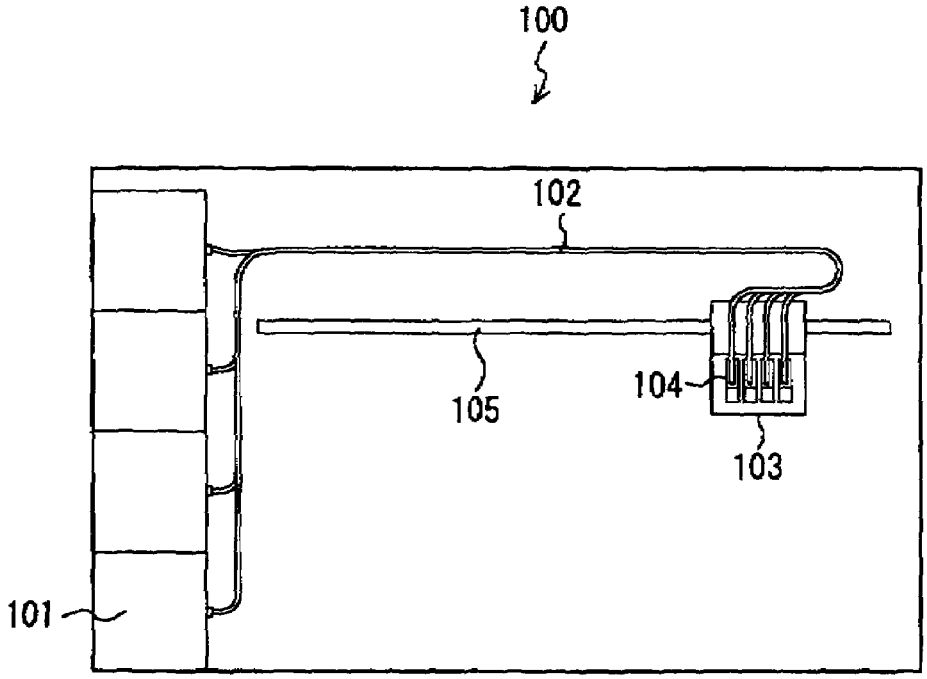
FIG. 17 is another plan sketch view of a conventional inkjet recording device 100.

Next, the second embodiment of the inkjet recording device realizing the present invention is explained with reference to the drawings. FIG. 14 is a side sketch view of the inkjet printer 1 according to the second embodiment; and FIG. 15 is an external perspective view of the protective member 70. With the inkjet printer 1 of the present embodiment, in addition to the constitution of the inkjet printer 1 according to the first embodiment, a protective member 70 is provided to the ink supply tubes 10*a* to 10*d* in the course of the ink supply tubes 10*a* to 10*d* from the ink cartridge housing unit 30 to the inkjet head 21.

As shown in FIG. 14 and FIG. 15, among the ink supply tubes 10*a* to 10*d* (illustrated as ink supply tube 10 in FIG. 10), the protective member 70 is provided to the respective ink supply tubes 10*a* to 10*d* regarding the portion from the guide member 40 to the tube support member 60. The protective member 70 is a flexible tube superior in heat resistance and durability, and, although the ink supply tubes 10*a* to 10*d* are respectively inserted into the protective member 70, the protective member 70 may also be a heat-resistant sheet to be wrapped around the ink supplied tubes 10*a* to 10*d*. The protective member 70, in addition to playing the role of protecting the ink supply tubes 10*a* to 10*d* from external elements such as outside pressure or temperature, it also prevents the adjacent ink supply tubes 10*a* to 10*d* from becoming jammed or entangled. In particular, the protective member 70 is effective while the carriage 20 is moving since the adjacent ink supply tubes 10*a* to 10*d* often become jammed or entangled.

Among the ink supply tubes 10*a* to 10*d*, the reason the protective member 70 was provided to the portion from the guide member 40 to the tube support member 60 is because this is the portion subject to the most severe fluctuation of the ink supply tubes 10*a* to 10*d* caused by the movement of the carriage 20. Needless to say, the protective member 70 may also be provided to the other portions of the ink supply tubes 10*a* to 10*d*, or plural protective members 70 may be provided to the respective ink supply tubes 10*a* to 10*d*.

Further, although the protective member 70 is provided to each of the ink supply tubes 10*a* to 10*d*, the respective protective members 70 may be connected via adhesion or fixation so as to integrally form such protective members 70.

With the inkjet printer 1 according to the second embodiment described above, since a protective member 70 for protecting plural supply tubes 10*a* to 10*d* is provided, in addition to playing the role of protecting the ink supply tubes 10*a* to 10*d* from external elements such as outside pressure or temperature, it also prevents the adjacent ink supply tubes 10*a* to 10*d* from becoming jammed or entangled.

Incidentally, in the foregoing first and second embodiments, the carriage 20 corresponds to the "recording head unit" of the present invention, the ink cartridge housing unit 30 corresponds to the "ink supply source" of the present invention, and the ink supply tubes 10*a* to 10*d* correspond to the "tubes" of the present invention.

In addition, the present invention is not limited to the foregoing first and second embodiments, and various modifications thereof are possible as a matter of course.

In the foregoing embodiments, the retaining members 47, 48, 49 and 50 for retaining the ink supply tubes 10*a* to 10*d* are housed in the housing units 80, 81, 82, 83 in the guide member 40. And, the retaining members 47, 48, 49 and 50 are constituted to be rotatable upon following the movement of the carriage 20 while being supported by the guide member 40. Nevertheless, it is also possible to directly house the ink supply tubes 10*a* to 10*d* in the housing units 80, 81, 82 and 83 without providing the retaining members 47, 48, 49 and 50. In such a case, the ink supply tubes 10*a* to 10*d* will rotate upon following the movement of the carriage 20 while being supported by the guide member 40.

Moreover, the number of ink supply tubes 10 is not limited, and an arbitrary number of ink supply tubes 10 may be supported by the guide 40. Further, an arbitrary number of housing units 80, 81, 82 and 83 may be provided to the guide 40, and an arbitrary number of ink supply tubes 10 may be adhered or fixed to the tube support member 60. In addition, guide members 40 or tube support members 60 may be provided to the inkjet printer 1.

Further, in the foregoing embodiments, although the constitution was such that the guide member 40 supported the ink supply tubes 10*a* to 10*d* in parallel and at the same height, and the position, arrangement and height of the housing units 80, 81, 82, 83 may also be provided arbitrarily by the user or designer. Moreover, although the guide member 40 is constituted to be rotatable around the bolt 43 provided to the approximately center position on the plane surface, the position of the rotational axis may also be provided arbitrarily by the user or designer.

The inkjet recording device of the present invention can be applied to an inkjet-type recording device which supplies ink to a recording means via a tube.

The entire disclosure of the specification, summary, claims and drawings of Japanese Patent Application No. 2004-006992 filed on Jan. 14, 2004 is hereby incorporated by reference.

What is claimed is:

1. An inkjet recording device comprising:

a recording head unit capable of recording while reciprocating along a recording medium;

a plurality of flexible tubes which each supply an ink from an ink supply source to said recording head, wherein said plural tubes are provided in a part of the course from said ink supply source to said recording head unit; and a guide member for supporting said plural tubes, wherein said guide member is rotatable along the reciprocating direction of said recording head unit, and said guide member is rotatable around a fixed point so as to be inclined obliquely in a horizontal direction towards both a right side and a left side of said inkjet recording device, thereby alleviating a bending pressure applied to said plural tubes.

2. An inkjet recording device according to claim 1, wherein said guide member has a housing unit for housing each of said plural tubes rotatably around the axis line of each of said plural tubes.

3. An inkjet recording device according to claim 2, wherein each of said housing unit is an approximately cylindrical through hole through which one of said plural tubes passes, and an approximately cylindrical retention member for retaining the one of said plural tubes is supported rotatably around the axis line of said housing unit inside said housing unit.

4. An inkjet recording device according to claim 3, wherein plural housing units are provided in correspondence with each of said plural tubes, each of said plural housing units is provided in parallel, and each of said plural housing units is provided such that the respective axis lines thereof are formed on the same plane.

5. An inkjet recording device comprising:

a recording head unit capable of recording while reciprocating along a recording medium;

a plurality of flexible tubes which each supply an ink from an ink supply source to said recording head, wherein said plural tubes are provided in a part of the course from said ink supply source to said recording head unit; and a guide member for supporting said plural tubes; wherein said guide member has a housing unit for housing each of said plural tubes rotatably around the axis line of each of said plural tubes; and said guide member is rotatable around a fixed point so as to be inclined obliquely in a horizontal direction towards both a right side and a left side of said inkjet recording device, thereby alleviating a bending pressure applied to said plural tubes.

* * * * *